United States Patent [19]

Yoshida et al.

[11] Patent Number: 4,544,142

[45] Date of Patent: Oct. 1, 1985

[54] ROTARY HEARTH FINISH ANNEALING FURNACE

[75] Inventors: Shigeru Yoshida, Kobe; Norihisa Shiraishi, Kurashiki; Chosei Asakawa; Morohira Sakaguchi, both of Kobe, all of Japan

[73] Assignee: Kawasaki Steel Corporation, Kobe, Japan

[21] Appl. No.: 590,074

[22] Filed: Mar. 15, 1984

[51] Int. Cl.[4] ..... C21D 9/673

[52] U.S. Cl. ..... 266/252; 266/256; 266/263; 266/274; 432/138; 432/254.2

[58] Field of Search ..... 266/249, 252, 255, 256, 266/262, 263, 274; 432/138, 254.2, 254.1, 260

[56] References Cited

U.S. PATENT DOCUMENTS

| | | | |
|---|---|---|---|
| 2,495,561 | 1/1950 | Wilson | 432/254.2 |
| 2,499,926 | 3/1950 | Lloyd | 432/138 |
| 2,509,209 | 5/1950 | Castle | 432/138 |
| 2,798,716 | 7/1957 | Pugh | 432/254.2 |
| 3,275,309 | 9/1966 | Wilson et al. | 266/252 |
| 3,378,242 | 4/1968 | Cone et al. | 432/138 |
| 4,406,618 | 9/1983 | Maeyama | 432/23 |

*Primary Examiner*—L. Dewayne Rutledge

*Assistant Examiner*—Christopher W. Brody

*Attorney, Agent, or Firm*—Balogh, Osann, Kramer, Dvorak, Genova & Traub

[57] ABSTRACT

A rotary hearth finish annealing furnace includes coil tables carrying thereon steel plate coils to be annealed with their axes being vertical, a hearth traveling along a circle having a predetermined radius and supporting thereabove the coil tables, inner covers covering the coils on the coil tables, and a protective cover covering the above members over a predetermined distance.

According to the invention, heating means for heating the coils are arranged at a level above upper ends of the steel plate coils. In a preferred embodiment, the coil tables are arranged so as to permit the coils to be arranged thereon in at least two circular rows on a single plane concentric to said traveling circle of the hearth. Moreover, portions of the hearth subjected to loads of the coils and coil tables are made of comparatively high strength bricks and the other portions are made of a light weight refractory material. With these arrangement, the furnace according to the invention operates with a high thermal efficiency to greatly save the energy required for its operation.

4 Claims, 11 Drawing Figures

ROTARY HEARTH FINISH ANNEALING FURNACE

BACKGROUND OF THE INVENTION

1. Field of the Invention

This invention relates to an annealing furnace for coiled steel plates, and more particularly to a rotary hearth finish annealing furnace for finish annealing coiled steel plates such as anisotropic electromagnetic steel plates or the like coated with an annealing parting agent.

2. Description of the Prior Art

The anisotropic electromagnetic steel plate is produced in steps of at least one time annealing and cooling hot rolled steel plates conditioned to contain less than 0.085% of carbon, less than 4% of silicon and less than 0.07% of elements aiding in secondary recrystallization such as sulfur, aluminum or the like, continuously decarburizing annealing the plates, coating the plates with a slurry of annealing parting agent such as magnesia, drying the coated plates, winding the dried plates into a coil, and finish annealing the coil. The finish annealing is usually effected by immersing the coil in a high pure reducing atmosphere gas at a high temperature (higher than 1,100° C.) for a long time (more than 10 hours) and then cooling to lower than 450° C., for the purpose of producing the secondary recrystallization and surface films and removing impurities.

The finish annealing has been effected in an annealing furnace as shown in FIG. 1, a schematic plan view of the furnace and FIG. 2, a sectional view taken along the line II—II in FIG. 1. A hearth or furnace bed 1 is supported by rollers 2 so as to travel along a circular line having a predetermined radius (for example 12.5 m). A substantially half of the circular hearth 1 is covered by a heat retaining cover 4 having burners 3 to form a heating zone 5 and one fourth next thereto is covered by a heat retaining cover without heating means such as burners to form a cooling zone 6 in the furnace. A further bed portion contiguous to the cooling zone 6 is not covered to form an external cooling zone 7 whose terminal end is provided between it and the heating zone 5 with a loading and unloading zone 8. Coil tables 10 are provided on the bed 1 through supports 11 so as to be able to locate steel plate coils 9 whose axes are vertical. The burners 3 are located at a level somewhat higher than an upper surface of the hearth 1. The steel plate coils 9 are covered by inner covers 12 filled with a reducing atmosphere gas such as hydrogen and are heated by burning gas from the burners 3 and the reducing atmosphere gas heated and raised in temperature by the burners 3. A reference numeral 13 in FIG. 2 denotes sealing means for keeping the hearth 1 and the heat retaining cover 4 in an air-tight manner.

With the above annealing furnace, however, the steel plate coils 9 are arranged in a single circular row without arranging them side by side in radial directions of the circular hearth and without piling them one upon the other as shown in phantom lines in FIG. 1. Its productivity is not necessarily high and its heat radiating area of the furnace wall per one coil is unduly large to consume a comparatively great amount of energy for the operation of the annealing furnace.

In order to avoid such disadvantages, it can be proposed to arrange two coil tables 10 and 10*a* one above the other to heat the coils 9 in an upper and a lower circular row. With such an arrangement, the productivity is improved and the heat radiating area per one coil is small. However, support members 14 for supporting the upper coil table 10*a* are needed and therefore to increase the heat capacity as a whole and to make difficult handling the coils 9 for loading and unloading the coils on and from such a high level.

In the above annealing furnaces shown in FIGS. 1–3, the burners 3 are located at the lower level of the furnaces to cause the burning gas and the heated gas raised in temperature having light specific weight to rise so as to heat the upper and intermediate portions of the furnaces with the aid of these gases, thereby maintaining the temperature in the furnaces substantially constant as a whole. However, because of the burners 3 located at the relatively low positions, the hearth 1 is heated directly by the burners 3, so that the temperature of the hearth 1 becomes high substantially to the degree of the ceiling of the furnace. As the result, the difference in temperature between the hearth and the atmosphere becomes great to increase the quantity of heat transmitted from the hearth to the atmosphere, i.e. dissipating heat radiated from the hearth. In addition, the heat accumulated in the hearth 1 increases and therefore to reduce the thermal efficiency with resulting high running cost.

As above described, the movable hearth 1 are subjected to heating and cooling cycles over a wide temperature range, consuming the thermal energy for raising the temperature of the movable hearth 1.

FIG. 4 illustrates a movable hearth as an example of the prior art. The movable hearth 1 supports thereon coil tables 10, coils 9 to be annealed and inner covers 12. A load acting upon the supports 11 is supported by firebricks 1*a* pyramidally piled in the hearth 1. A weight of the inner cover 12 is supported by heat insulating bricks 1*b* piled about the firebricks 1*a*, about which refractory casters 1*c* are provided. A support metal members 1*d* are provided on the sides of the heat insulating bricks 1*b* to support traverse thermal expansion of the heat insulating bricks 1*b*. The movable hearth 1 is accommodated in its entirety in hearth metal members 1*e*. A sealing material 1*f*, for example, mullite sand or the like is filled between the lower end of the inner cover 12 and the heat insulating bricks 1*b* for sealing atmosphere gas in the inner cover 12.

In this manner, the movable hearth 1 of the prior art comprises the firebricks 1*a* having a bulk specific gravity of 2.0 and a thermal conductivity of 2.4 Kcal/mh°C. (at 1,000° C.), the heat insulating bricks 1*b* having a bulk specific gravity of 0.7 and a thermal conductivity of 0.55 Kcal/mh°C. (at 1,000° C.) and the refractory casters 1*c* having a bulk specific gravity of 1.5 and a thermal conductivity of 1.4 Kcal/mh°C. (at 1,000° C.). The movable hearth thus constructed is rigid, but heavy and has a thermal conductivity of more than 0.8 Kcal/mh°C. (at 1,000° C.) as a whole resulting in a great heat loss.

When the movable hearth 1 expands at a high temperature, moreover, the sealing material 1*f* penetrates into joints of the heat insulating bricks 1*b*. As the result, when cooled, the bricks 1*b* are subjected to forces to be expanded in traverse directions of the hearth, so that the bricks 1*b* progressively move away from each other resulting finally in damage to the movable hearth.

SUMMARY OF THE INVENTION

It is an object of the invention to provide an improved rotary hearth finish annealing furnace which eliminates the above disadvantages of the prior art and operates with a high thermal efficiency to save the energy required for its operation.

In order to achieve this object, the rotary hearth finish annealing furnace including coil tables carrying thereon steel plate coils to be annealed with their axes being vertical, a hearth traveling along a circle having a predetermined radius and supporting thereabove said coil tables, inner covers covering said coils on said coil tables, and a protective cover covering said above members over a predetermined distance, according to the invention comprises heating means for heating an interior of the furnace located at a level above upper ends of said steel plate coils.

In a preferred embodiment of the invention, the coil tables are arranged on the hearth so as to permit the coils to be arranged thereon in at least two circular rows on a single plane concentric to the traveling circle of the hearth.

The invention resides in the following discovery in an earnest investigation by the inventors on heat transmission and temperature variation with lapse of time in various parts of an annealing furnace depending upon locations of heating means.

In annealing anisotropic electromagnetic steel plates or the like, one surface or both surfaces are coated with a slurry of annealing parting agent, such as magnesia and dried as above described. As a heat conductivity of the annealing parting agent is very small, the thermal transmission across surfaces of the coiled plate or in radial directions of the coil is obstructed by the parting agent, while the thermal transmission through the plate in its traverse directions or axial directions of the coil is allowed because of the high heat conductivity of the steel plate itself.

Moreover, the coil tables for supporting coils to be annealed are generally made of a heat-resisting steel whose heat conductivity is of the order of one third to one half of that of plain carbon steel as shown in FIG. 5. Furthermore, the coil table is made to have a thickness of 100–250 mm in order to assure a required strength. Accordingly, the coil table adversely prevent the heat transmission therethrough to the lower end of the coil to reduce heat input through the lower end of the coil.

In view of the above two facts, it is considered that the steel plate coil mainly receives the heat irrespectively of locations of heating means. It has been found in further experiments by the inventors on the basis of the knowledge that the steel plate coils are sufficiently heated, even if the heating means are located at a level above upper ends of the coils.

It is another object of the invention to provide an annealing furnace whose hearth is light weight and has a very low heat conductivity, thereby greatly decrease the heat loss to considerably contribute the energy saving and the hearth eliminates the above disadvantage of the prior art caused by the thermal expansion in conjunction with sealing material.

In order to achieve this object, the hearth according to the invention comprises one portions made of relatively higher strength refractory materials which are subjected to loads such as the coil tables, coils and inner covers and the other portions made of relatively lower strength refractory materials.

In order that the invention may be more clearly understood, preferred embodiments will be described, by way of example, with reference to the accompanying drawings.

DETAILED DESCRIPTION OF THE PREFERRED EMBODIMENT

Figure 6:
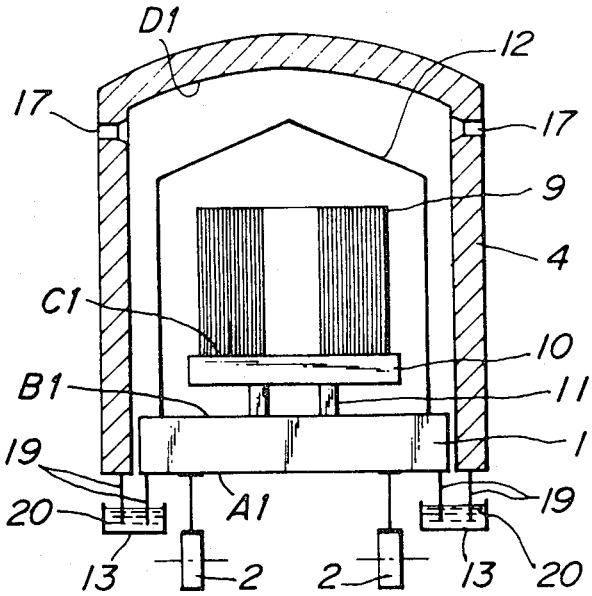
FIG. 6 is a sectional view of one embodiment of the rotary hearth finish annealing furnace according to the invention.

FIG. 6 illustrates one embodiment of a rotary hearth finish annealing furnace according to the invention, a heat retaining cover 4 has a predetermined length and opens its bottom. A hearth 1 is arranged movably along the heat retaining cover 4 with the aid of rollers 2. Coil tables 10 are provided through supports 11 on the hearth 1 for loading steel plate coils 9 with the axes being vertical. Inner covers 12 are further provided on the hearth 1 for covering the coils 9 on the coil tables 10. The heat retaining cover 4 is provided with heating means 17 such as gas or heavy oil burners directing inwardly of the furnace at a level above upper ends of the coils located on the coil tables. A reference numeral 13 in FIG. 6 denotes sealing means having a sealing liquid 20 into which lower ends of sealing plates 19 extending downward from the heat retaining cover 4 and hearth are immersed to seal between the heat retaining cover 4 and the hearth 1 in an air-tight manner.

In annealing the steel plate coils 9 in the above annealing furnace, the coils 9 are arranged on the coil tables 10 with their axes being vertical and covered by the inner covers 12 into which a reducing atmosphere gas as hydrogen or the like is filled. Under this condition, the heating means 17 are started to heat the interior of the furnace. Because the heating means 17 are located at the higher level of the furnace, starting from an upper portion of the inner space in the heat retaining cover 4 or near its ceiling, the temperature of the inner space is progressively raised. Fortunately, as the steel plate coils 9 exhibit a good heat transmission in their axial directions, the temperature of the coils 9 as a whole starts to rise, even if the temperature on the side of the hearth is not raised.

Figure 1:
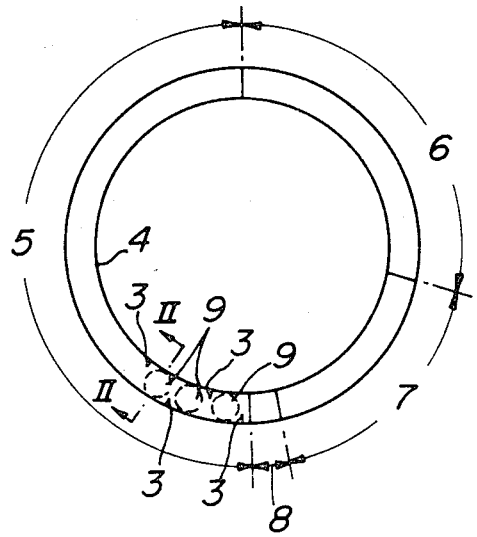
FIG. 1 PRIOR ART
FIG. 1 is a schematic plan view of one example of a rotary hearth finish annealing furnace of the prior art.
Figure 2:
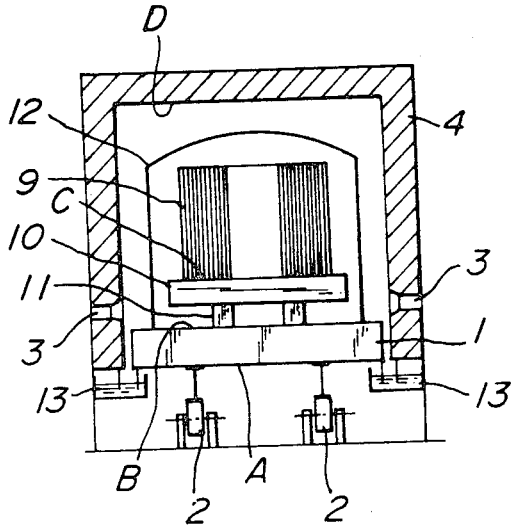
FIG. 2 PRIOR ART
FIG. 2 is an enlarged sectional view taken along the line II—II in FIG. 1.
Figure 7:
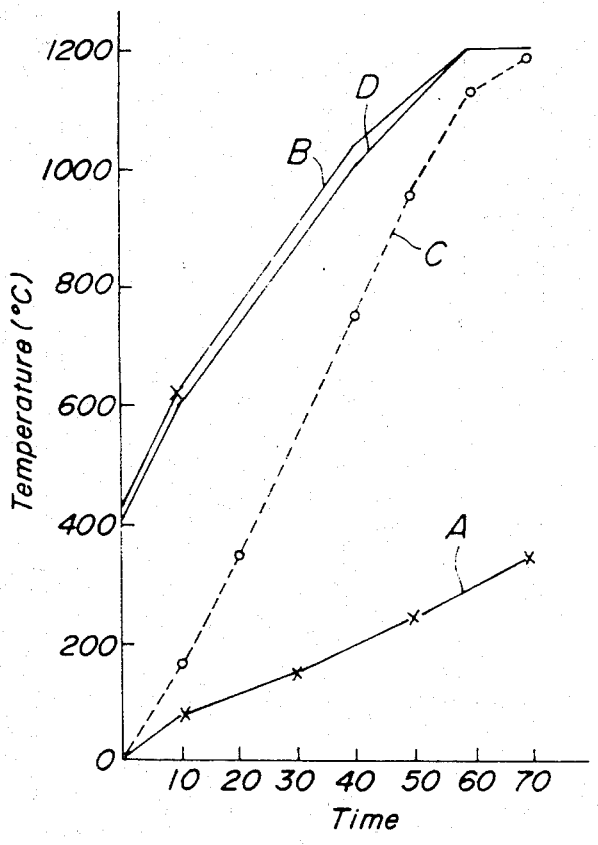
FIG. 7 PRIOR ART
FIG. 7 is a graph illustrating variation in temperature during heating at various points of the furnace of the prior art shown in FIG. 2.
Figure 8:
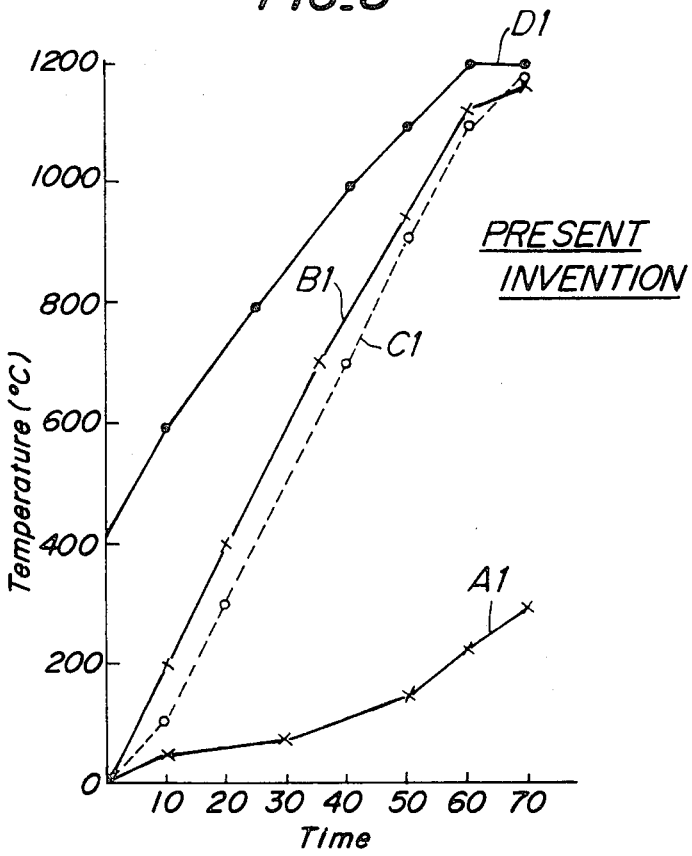
FIG. 8 is a graph illustrating variation in temperature during heating at various points of the furnace according to the invention shown in FIG. 6.

FIGS. 8 and 7 illustrate variation in temperature after starting to heat at various points of the furnaces according to the prior art shown in FIG. 2 and this invention shown in FIG. 6. In these experiments, anisotropic electromagnetic steel plates containing silicon less than 4% for obtaining electromagnetic characteristics were hot rolled and thereafter the rolled steel plates were cold rolled and annealed one or more times. The steel plates were then coated with an annealing parting agent and wound into rolls. In FIG. 7, lines A, B, C and D show temperatures during heating at the lower surface A and the upper surface B of the hearth and at the lowest temperature point C of the coil 9 and ceiling D of the heat retaining cover 4, respectively. In FIG. 8, lines A1, B1, C1 and D1 show temperatures at the lower surface A1 and the upper surface B1 of the hearth and at the lowest temperature point C1 of the coil 9 and ceiling D1 of the heat retaining cover 4, respectively.

As can be seen from the lines of the furnace of the prior art shown in FIG. 8, the temperature at the upper surface B of the hearth 1 varied to the higher temperature to substantially the same extent as the temperature at the ceiling D. The temperature at the lower surface A of the hearth 1 rised substantially linearly and finally arrived at the order of 350° C. (after 70 hours from starting to heat).

In contrast herewith, the furnace according to the invention, as shown in FIG. 8, although the temperature at the ceiling D1 varied in the same manner as in the prior art, the temperature at the upper surface B1 of the hearth 1 varied with values lower than those of the prior art by the order of 50°-400° C., and the temperature at the lower surface A1 of the hearth varied with values lower than those of the prior art by the order of 50°-100° C. Moreover, the temperature at the lowest temperature point C1 of the coils varied with values lower than those of the prior art by the order of 50° C. but finally arrived at substantially the same temperature (about 1,200° C.) as that of the prior art.

It can be clearly recognized from the above result that with the annealing furnance according to the invention as the temperature at the hearth 1 varies at the lower values, a heat loss due to accumulating the heat in the hearth 1 is minimum and as the temperature at the lower surface A1 of the hearth 1 contacting the atmospheric air varies at the lower values, the heat to be transferred or dissipated to the atmospheric air is minimum. According to the invention, the annealing furnace, therefore, reduces the heat supplied from the heating means but dissipated into the atmospheric air and consumed for heating components other than the steel coils 9, thereby greatly improving its thermal efficiency in comparison with that of the prior art furnace.

Furthermore, although the rotary hearth finish annealing furnace has been explained as an example in the above embodiment, the present invention is not limited to the above embodiment and is applicable to a batch type finish annealing furnace. Moreover, the annealing furnace according to the invention can of course be used for annealing steel plates other than anisotropic electromagnetic steel plates.

As can be seen from the above explanation, the finish annealing furnace according to the invention comprises heating means for heating the interior of the furnace arranged at a level above upper ends of steel plate coils covered by the inner cover and located with their axes being vertical on the coil tables, thereby enabling the coils to be heated at least to substantially the same extent as in the prior art because of the good heat transmission of the coils in their axial directions and thereby reducing the heat consumed for heating the hearth and hence dissipated into the atmospheric air to considerably decrease the heat loss as a whole in comparison with the prior art, whereby the steel coils can be heated without any difficulty with remarkably higher thermal efficiency.

Figure 9:
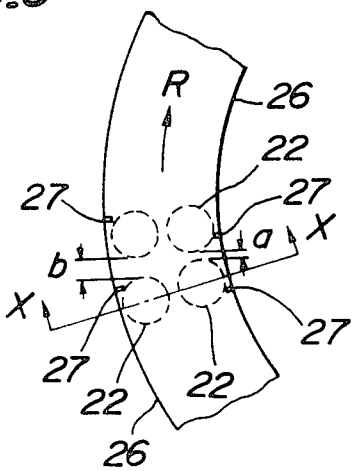
FIG. 9 is a schematic partial plan view of a preferred embodiment of the invention.
Figure 10:
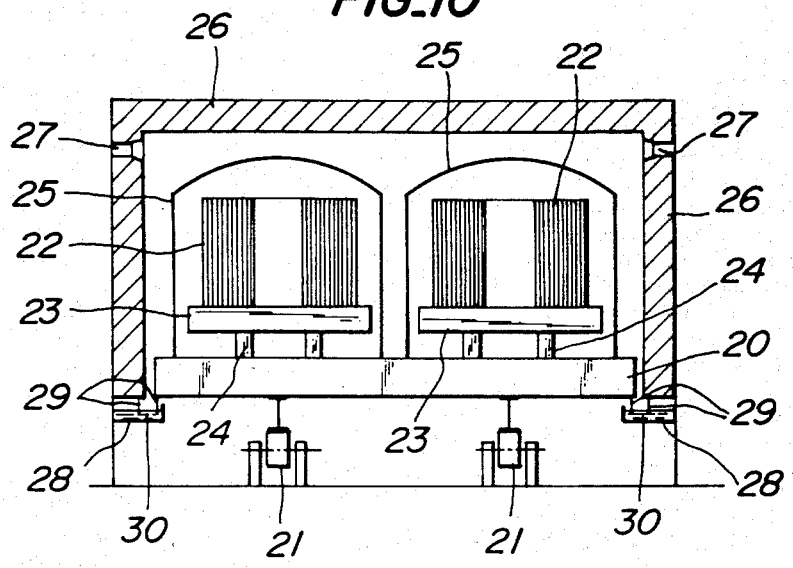
FIG. 10 is an enlarged sectional view taken along line X—X in FIG. 9.

Referring to FIG. 9 illustrating another embodiment of the invention in a schematic partial plan view and FIG. 10, enlarged sectional view taken along the line X—X in FIG. 9, a rotary hearth 20 is supported by rollers 21 so as to travel on a circular line having a predetermined radius. A width of the rotary hearth 20 is wider than twice diameters of steel coils to be annealed. Coil tables 23 are located on the rotary hearth 20 through supports 24. As shown in FIG. 10, the coil tables 23 are so arranged that steel coils 22 are respectively loaded with their axes being vertical on the coil tables 23 and are concentrically or in two circular rows in a traveling direction of the hearth 20 (shown by an arrow R in FIG. 9). These steel coils 22 are covered by inner covers 25 suitably filled with a reducing atmosphere gas such as hydrogen. The rotary hearth 20 is covered over its a predetermined length by a heat retaining cover 26 of which part forms a heating zone and is provided with heating means 27 such as gas or heavy oil burners inwardly directing with a predetermined interval at a level above upper ends of the coils 22 located on the coil tables 23. A reference numeral 28 in FIG. 10 denotes sealing means having a sealing liquid 30 into which lower ends of sealing plates 29 extending downward from the hearth 20 and the heat retaining cover 26 are immersed to seal between the heat retaining cover 26 and the hearth 20 in an air-tight manner.

In annealing the steel coils 22 in the rotary hearth finish annealing furnace, the steel coils 22 are arranged on the coil tables at a loading and unloading zone (not shown) and covered by the inner covers 25 into which a reducing atmosphere gas as hydrogen or the like is filled. Under this condition, the steel coils 22 are transferred into a heating zone and heated by the heating means 27 during traveling in the heating zone. In this case, because the heating means 27 are located at the higher level of the furnace, starting from an upper portion of the inner space in the heat retaining cover 26 or near its ceiling, the temperature of the inner space is progressively raised. As the steel coils 22 exhibit a good heat transmission in their axial directions, the temperature of the coils 22 as a whole starts to rise, even if the temperature on the side of the hearth is not raised.

In other words, although the lowest temperature portions or the lower ends of the steel coils are being heated at temperature somewhat lower than those of the prior art because they are mainly heated by the heat input from the upper ends of the steel coils, the temperature of the lower ends of the steel coils is finally raised no less high than required temperatures. Moreover, as the heating means 27 are greatly remote from the hearth 20, the temperature of the hearth can be restrained at much lower levels than that of the prior art during its rising.

The finish annealing furnace above mentioned, therefore, can reduce the heat dissipating from the hearth into the atmospheric air and the heat to be accumulated in the hearth 20. In addition thereto, the area of the heat retaining cover 22 radiating the heat into the atmospheric air is not so much increased even if it receives the twice number of the coils. The heat radiating from the heat retaining cover 26 into the atmospheric air can be restrained at a lower level. Accordingly, this annealing furnace can anneal increased number of steel coils without increasing quantity of heat in proportion to the increase of the coil number, thereby annealing steel coils with high thermal efficiency.

In view of two rows of steel coils of this annealing furnace, distances a between the adjacent inner covers 25 located in the inner circle on the hearth 20 and distances b between the adjacent inner covers 25 in the outer circle are different as shown in FIG. 9. However, as the heating means 27 are arranged at locations above the upper ends of the steel plate coils 22, any thermal unbalance can be prevented with the aid of the good heat transmission of the coils in their axial directions. In the event that the heating means 27 are gas or heavy oil burners, moreover, flames of the burners do not directly impinge on the inner covers 25 even if the distance a are narrower, thereby elongating service life of the inner cover. With this annealing furnace, arranging the steel coils 22 in two circular rows on a single plane makes it easy to loading and unloading the coils on the hearth.

Figure 3:
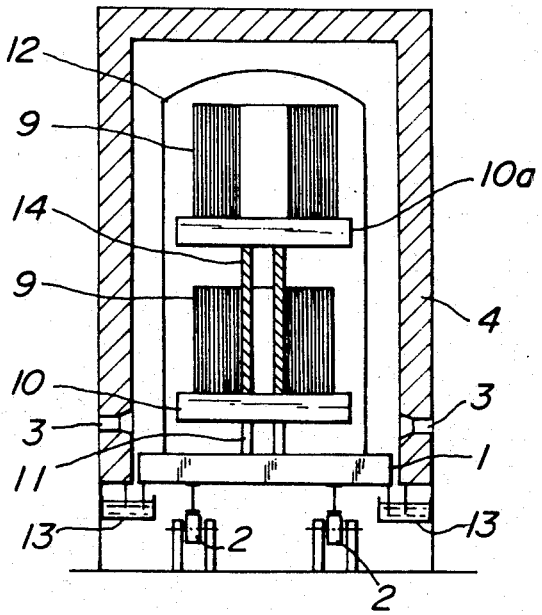
FIG. 3 PRIOR ART
FIG. 3 is a sectional view of a rotary hearth finish annealing furnace capable of loading steel coils one above the other of the prior art.

In order to clarify the effect of the annealing furnace, the inventors carried out the following experiments. In these experiments, anisotropic electromagnetic steel plates containing silicon less than 4% were hot rolled and thereafter the rolled steel plates were cold rolled and annealed one or more times. The steel plates were then coated with an annealing parting agent and wound into rolls which were ready for finish annealing. The coils were arranged in two rows on a single plane in the rotary hearth finish annealing furnace as shown in FIG. 10. In order to compare therewith, on the other hand, the coils were arranged in a single row in the rotary hearth furnace of the prior art as shown in FIG. 2 and the other coils were arranged in upper and lower rows in the furnace as shown in FIG. 3. The results are shown in Table 1.

TABLE 1

| Furnace | Arrangement of coils | Heat required for finish annealing Kcal/ton |
|---|---|---|
| Present invention | In two rows on single plane | 500,000 |
| Prior art | In single row on single plane | 600,000 |
| | In upper and lower rows | 550,000 |

It is clearly evident from the table 1, that according to the invention the heat required to anneal coils per a unit weight can be remarkably reduced.

As can be seen from the above description, the finish annealing furnace comprising heating means arranged at locations above upper ends of coils, thereby maintaining the temperature of the hearth at lower level without obstructing the heating the coils and therefore keeping small the temperature gradient between the hearth and the atmosphere so as to reduce the heat dissipated into the atmosphere to remarkably improve the thermal efficiency. With the arrangement of the coils in two rows on a single plane, the heat radiation area of the heat retaining cover becomes smaller in comparison with increased number of the coils to improve the thermal efficiency, and loading and unloading the coils on and from coil tables are facilitated.

Figure 11:
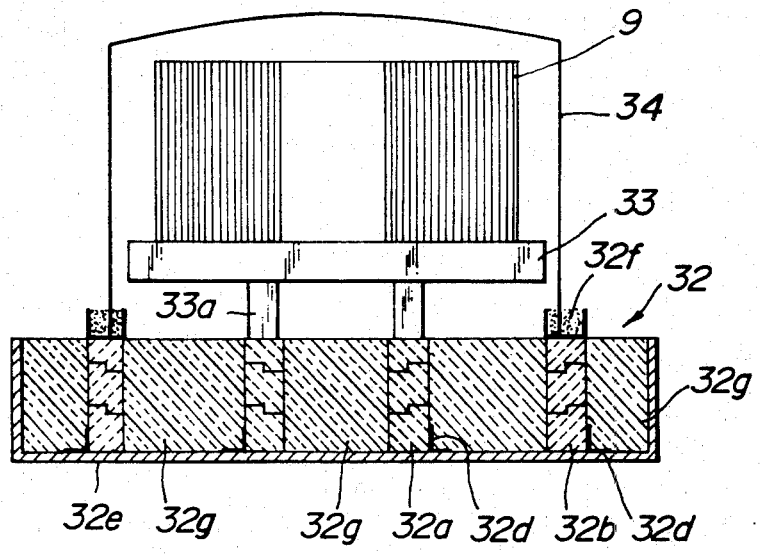
FIG. 11 is a sectional view of a hearth with a coil table, coil and an inner cover according to the invention.

Referring to FIG. 11 illustrating a further embodiment of the invention for solving the problem in the movable hearth of the prior art, portions of a movable hearth 32 supporting a load acting upon supports 33*a* for a coil table 33 are formed by firebricks 32*a* cylindrically piled. Each the piled firebrick column 32*a* is provided at its lower outside with a retaining metal member 32*d*.

Moreover, portions of the movable hearth 32 supporting a load of an inner cover 34 are formed by thermal insulating bricks 32*b* cylindrically piled. Each the piled brick column 32*b* is provided at its lower outside with a retaining metal member 32*d*.

Portions of the movable hearth 32 other than the firebricks 32*a* and the insulating bricks 32*b* are formed by a light weight refractory material 32*g* having a lower strength such as ceramic fibers.

In view of the required strength and energy saving, the sum of sectional areas of the firebricks 32*a* and the insulating bricks 32*b* is preferably of the order of 35% of the total sectional area of the overall movable hearth 32 and thus the sectional area of the light weight refractory material 32*g* is preferably 65% of the total area of the hearth 32.

In cylindrically piling the firebricks 32*a* and the insulating bricks 32*b*, there are preferably provided fitting steps or shoulders or depressions and protrusions in the firebrick and insulating brick columns so as to permit to fit the upper and lower bricks with each other.

The ceramic fiber selected as the light weight refractory material 32*g* in the above embodiment has a bulk specific gravity 0.2 and a heat conductivity 0.3 Kcal/mh°C. Such a bulk specific gravity is one tenth of that of the firebricks 32*a* and is less than one third of that of the insulating bricks 32*b*, and such a heat conductivity is one third of that of the firebricks 32*a* and is one half of that of the insulating bricks 32*b*. Moreover, as the sectional area of the light weight refractory material 32*g* is of the order of the overall sectional area of the movable hearth 32, the total weight of the new movable hearth 32 is of the order of one fifth of the weight of the hearth of the prior art. Furthermore, the heat conductivity of the movable hearth 32 as a whole is approximately one fifth of that of the hearth of the prior art, thereby greatly decrease the heat loss to considerably contribute the energy saving.

Moreover, as the light weight refractory material 32*g* has the low strength, even if a sealing material 32*f* penetrates into joints of the light weight refractory material 32*g*, the penetrating sealing material is accommodated by deformation of the light weight refractory material itself, so that there is no risk of breaking down of the movable hearth 32.

Figure 4:
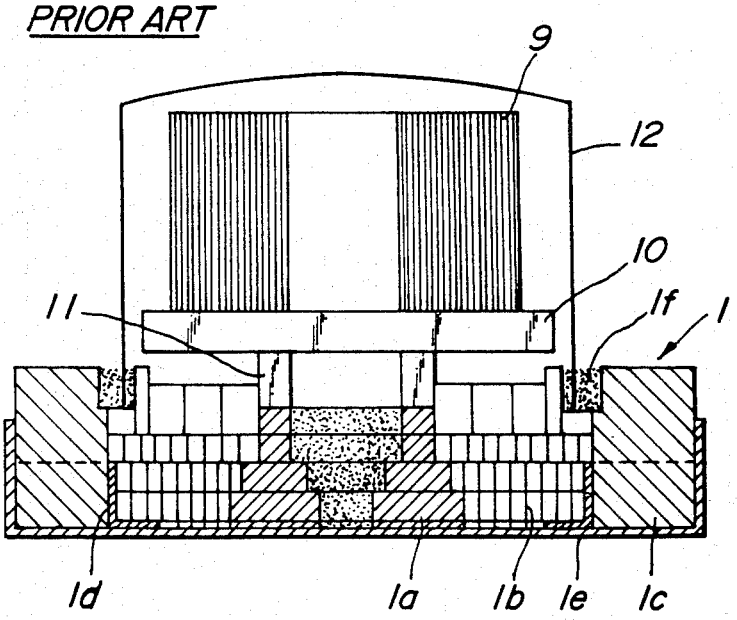
FIG. 4 PRIOR ART
FIG. 4 is a sectional view of a movable hearth of an annealing furnace of the prior art.
Figure 5:
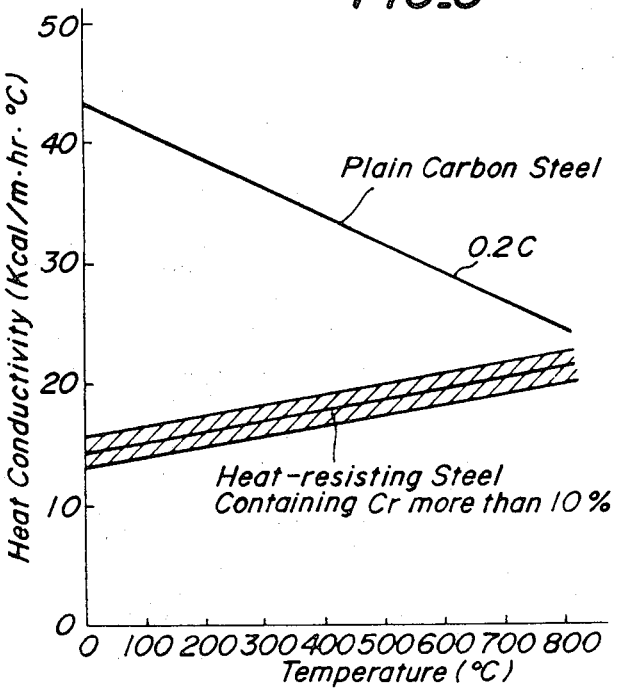
FIG. 5 is a graph illustrating heat conductivities of a plain carbon steel and a heat-resisting steel for making coil tables.

In this connection, anisotropic electromagnetic steel plate coils having a plate thickness 0.35 mm, a plate width 1,000 mm, an outer diameter 1,600 mm, an inner diameter 500 mm and a weight 14 tons to be finish annealed were arranged on the coil tables of the movable hearth of the finish annealing furnace of the prior art shown in FIG. 4. The similar steel plate coils were arranged on the movable hearth of the finish annealing furnace according to the invention shown in FIG. 11. These coils were heated to 1,170° C. for 70 hours and then cooled to 450° C. for 60 hours, respectively. An accumulated heat in the movable hearth of the prior art is 90,000 Kcal per one ton of steel plate coils, while an accumulated heat in the movable hearth according to the invention is 20,000 Kcal per one ton of coils, so that a considerable energy saving such as 70,000 Kcal can be accomplished according to the invention.

As can be seen from the above explanation, the rotary hearth finish annealing furnace according to the invention has the particular construction as above described to provide the advantages reducing the heat consumed for heating the hearth and hence dissipated into the atmosphere and heat radiated from the heat retaining cover to considerably decrease the heat loss as a whole, thereby considerably improving the thermal efficiency of the furnace.

It is further understood by those skilled in the art that the foregoing description is that of preferred embodiments of the disclosed furnaces and that various changes and modifications may be made in the invention without departing from the spirit and scope thereof.

What is claimed is:

1. A rotary hearth finish annealing furnace including coil tables carrying thereon steel plate coils to be annealed with their axes being vertical, a hearth traveling along a circle having a predetermined radius, said coil tables being supported on said hearth so as to permit said coils to be arranged thereon in at least two circular rows on a single plane concentric to said traveling circle of said hearth, inner covers covering said coils on said coil tables, a protective cover covering said above members over a predetermined distance, and heating means for heating an interior of the furnace located at a level above upper ends of said steel plate coils, said hearth including one portion formed of a relatively higher strength refractory materials and another portion made of relatively lower strength refractory materials, wherein said portions of the hearth subjected to the load of the coil tables and coils are made of firebricks, said one portion of said hearth subjected to the load of the inner covers being formed of thermal insulating bricks, and said other portion being formed of a light-weight refractory material.

2. A rotary hearth finish annealing furnace as set forth in claim 1, wherein a sum of sectional areas of said one portions of the hearth is approximately 35% of a total sectional area of the hearth.

3. A rotary hearth finish annealing furnace as set forth in claim 1, wherein said one portions of said hearth subjected to the loads are formed by bricks which are piled in a manner forming shoulders fitting upper bricks and lower bricks with each other.

4. A rotary hearth finish annealing furnace as set forth in claim 1, wherein retaining metal members are provided at their bottom on their outsides to retain the firebricks and thermal insulating bricks.

* * * * *